US011660879B2

(12) United States Patent
Sakai et al.

(10) Patent No.: US 11,660,879 B2
(45) Date of Patent: May 30, 2023

(54) INK JET PRINTER

(71) Applicant: Roland DG Corporation, Hamamatsu (JP)

(72) Inventors: Chihiro Sakai, Hamamatsu (JP); Akihiro Suzuki, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 17/677,041

(22) Filed: Feb. 22, 2022

(65) Prior Publication Data

US 2022/0266608 A1 Aug. 25, 2022

(30) Foreign Application Priority Data

Feb. 22, 2021 (JP) ..... JP2021-026047

(51) Int. Cl.
*B41J 11/00* (2006.01)
*B41J 29/377* (2006.01)

(52) U.S. Cl.
CPC ..... *B41J 11/002* (2013.01); *B41J 29/377* (2013.01)

(58) Field of Classification Search
CPC .... B41J 11/002; B41J 29/377; B41J 11/0022; B41J 11/0045
See application file for complete search history.

(56) References Cited

U.S. PATENT DOCUMENTS

| | | | | |
|---|---|---|---|---|
| 2018/0004143 | A1 | 1/2018 | Sasaki | |
| 2018/0272754 | A1 | 9/2018 | Matsuoka | |
| 2020/0247144 | A1* | 8/2020 | Yoda | B41J 11/0022 |

FOREIGN PATENT DOCUMENTS

| | | | |
|---|---|---|---|
| CN | 102501600 | A | 6/2012 |
| JP | 2012-013297 | A | 1/2012 |
| JP | 2016-155292 | A | 9/2016 |
| JP | 2018-001501 | A | 1/2018 |
| JP | 2018-024221 | A | 2/2018 |
| JP | 2018-159482 | A | 10/2018 |
| JP | 2020-121500 | A | 8/2020 |

* cited by examiner

*Primary Examiner* — Bradley W Thies
(74) *Attorney, Agent, or Firm* — Keating & Bennett, LLP

(57) ABSTRACT

A printer includes a first guide disposed downstream of a platen in a sub-scanning direction to guide movement of a recording medium, a second guide disposed below the first guide and downstream of the first guide in the sub-scanning direction to guide movement of the recording medium, and a dryer facing the first guide and the second guide to send air toward the recording medium. The dryer includes a body case including an outlet port that is open toward the second guide, a fan to send air toward the recording medium through the outlet port, and a heater to heat air sent by the fan. The first guide has a thermal conductivity higher than a thermal conductivity of the second guide.

5 Claims, 5 Drawing Sheets

INK JET PRINTER

CROSS REFERENCE TO RELATED APPLICATIONS

This application claims the benefit of priority to Japanese Patent No. 2021-26047 filed on Feb. 22, 2021. The entire contents of this application are hereby incorporated herein by reference.

BACKGROUND OF THE INVENTION

1. Field of the Invention

The present invention relates to an ink jet printer.

2. Description of the Related Art

A known ink jet printer prints an image on a recording medium in an ink jet manner. The ink jet printer of this type includes, for example, a platen on which a recording medium is placed and ink heads that discharge ink onto the recording medium placed on the platen. For some types of ink to be used, an ink jet printer includes a drying device, such as a heater or a fan, for promoting drying of ink discharged onto a recording medium.

For example, JP2018-159482 discloses an ink jet printer including a drying device having a plurality of fans as a means for promoting drying of ink discharged onto a recording medium. The drying device is configured to send air toward the recording medium from above the recording medium. A portion of the recording medium on which ink has been discharged is conveyed from a platen to a downstream platen (hereinafter referred to as a guide member), and heated air is sent toward the recording medium from the drying device at a position facing the guide member to thereby promote drying of the ink.

The guide member is also heated by air from the drying device so that drying of ink discharged onto the recording medium is also promoted by heat of the guide member. Here, in a case where a material constituting the guide member has a relatively high thermal conductivity, a large quantity of heat is dissipated to the outside, and thus, efficiency in drying ink with heat of the guide member might decrease. On the other hand, in a case where the material constituting the guide member has a relatively low thermal conductivity, temperature variation might occur in the guide member and affect drying of ink.

SUMMARY OF THE INVENTION

Preferred embodiments of the present invention provide ink jet printers each including a dryer capable of promoting drying of ink discharged onto a recording medium.

An ink jet printer according to a preferred embodiment of the present invention includes a platen on which a recording medium is placed, a carriage disposed above the platen and movable in a main scanning direction, an ink head mounted on the carriage to discharge ink onto the recording medium, the recording medium being conveyed in a sub-scanning direction orthogonal to the main scanning direction, a first guide including an upper surface on which the recording medium is conveyed, the first guide being disposed downstream of the platen in the sub-scanning direction to guide movement of the recording medium, a second guide including an upper surface on which the recording medium is conveyed, the upper surface being tilted obliquely downward from an upstream side to a downstream side in the sub-scanning direction, the second guide being disposed below the first guide and downstream of the first guide in the sub-scanning direction to guide movement of the recording medium, and a dryer facing at least the second guide to send air toward the recording medium. The dryer includes a body case including an output port that is open toward at least the second guide, a fan disposed in the body case to send air toward the recording medium through the outlet port, and a heater disposed in the body case to heat air sent by the fan. The first guide has a thermal conductivity higher than a thermal conductivity of the second guide.

In an ink jet printer according to a preferred embodiment of the present invention, air heated by the heater of the dryer is sent to the recording medium through the outlet port. Since the outlet port is open toward the second guide, drying of ink on the recording medium on the upper surface of the second guide is promoted. Since the thermal conductivity of the second guide is lower than the thermal conductivity of the first guide, heat dissipation to the second guide is reduced or prevented, and air at a relatively high temperature is allowed to flow in the second guide. That is, drying of ink discharged onto the recording medium can be promoted in the second guide. In addition, heated air flowing from the outlet port toward the second guide rises and flows on the upper surface of the first guide. Accordingly, drying of ink on the recording medium on the upper surface of the first guide is promoted, and the first guide is heated. Since the thermal conductivity of the first guide is higher than the thermal conductivity of the second guide, heat is transferred to a wide range in the first guide so that temperature distribution in the first guide can be made uniform or substantially uniform. That is, it is possible to prevent the occurrence of variation in drying ink in the first guide, while promoting drying of ink in the first guide. Since the second guide having a low thermal conductivity is located below the first guide, transfer of heat from the first guide to the second guide is reduced or prevented so that the temperature of the first guide can be maintained.

Preferred embodiments of the present invention provide ink jet printers each including a dryer capable of promoting drying of ink discharged onto a recording medium.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
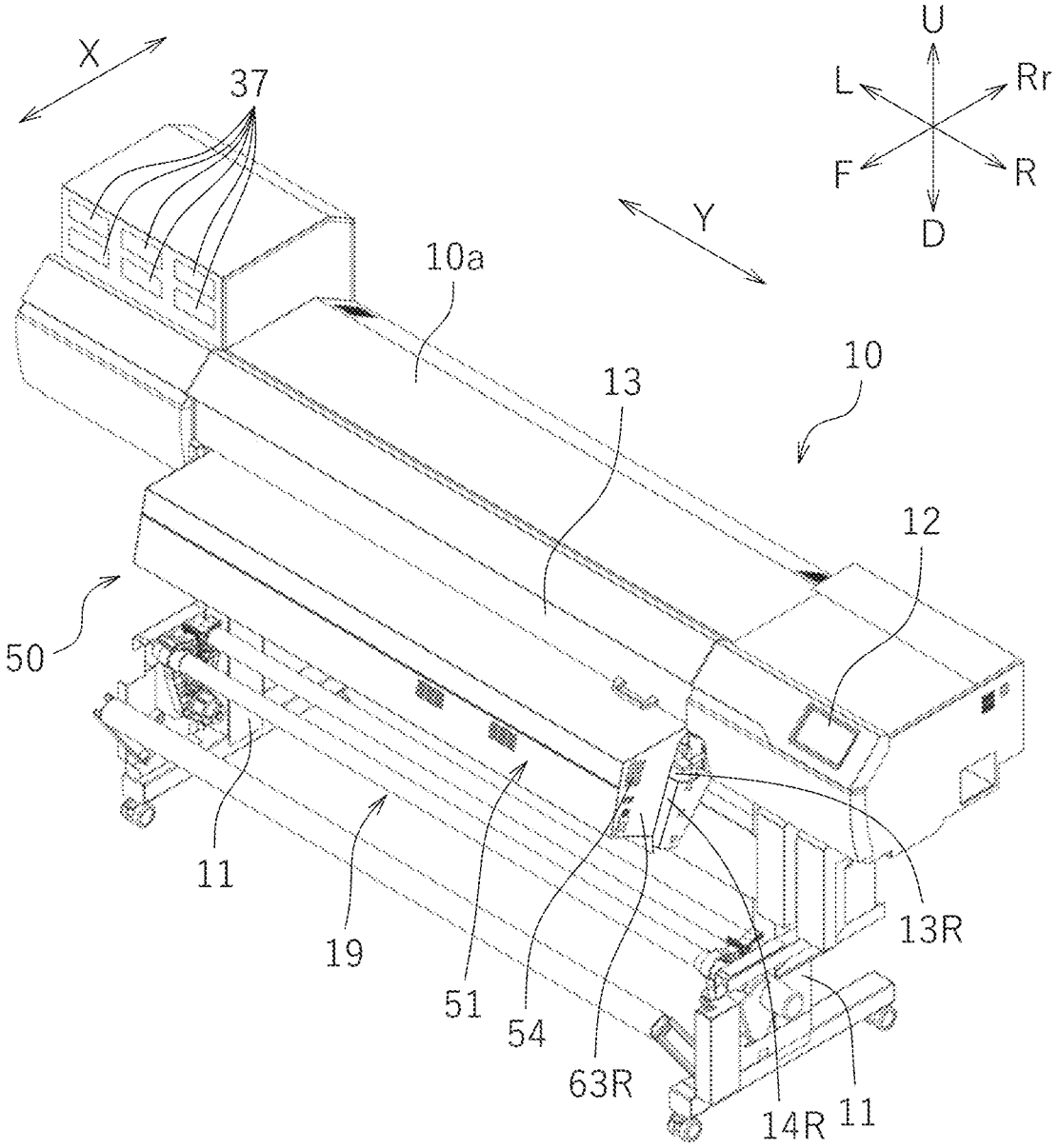
FIG. 1 is a perspective view of a printer according to a preferred embodiment of the present invention.

Ink jet printers (each hereinafter simply referred to as a "printer") according to preferred embodiments of the present invention will be described hereinafter with reference to the drawings. The preferred embodiments described here are, of course, not intended to particularly limit the present invention. Elements and features having the same functions are denoted by the same reference numerals, and description for the same members and parts will not be repeated or will be simplified as appropriate.

FIG. 1 is a perspective view illustrating a printer 10 according to a preferred embodiment of the present invention. The printer 10 performs printing on a recording medium 5 (see FIG. 2). The recording medium 5 is, for example, a recording sheet. The recording medium 5, however, is not limited to a recording sheet. The recording medium 5 may be made of a resin material such as polyvinyl chloride (PVC) or polyester, a metal sheet of, for example, aluminum or iron, a glass sheet, a wood sheet, or a corrugated cardboard, for example, as well as papers such as plain paper or ink jet printing paper.

In the following description, left, right, up, and down respectively refer to left, right, up, and down seen from an operator at the front of the printer 10. A direction from the rear of the printer 10 toward the operator facing the front of the printer 10 will be referred to as forward, and a direction from the operator toward the rear of the printer 10 will be referred to as rearward. Characters F, Rr, L, R, U, and D in the drawings represent front, rear, left, right, up, and down, respectively. A carriage 30 described later (see FIG. 2) is movable leftward and rightward. Supposing the rear side of the printer 10 is an upstream side and the front side of the printer 10 is a downstream side, the recording medium 5 is conveyed from the upstream side to the downstream side. In this preferred embodiment, the movement direction of the carriage 30 will be referred to as a main scanning direction Y, and the conveyance direction of the recording medium 5 will be referred to as a sub-scanning direction X. The main scanning direction Y corresponds to a left-right direction, and the sub-scanning direction X corresponds to the front-rear direction. The main scanning direction Y is orthogonal to the sub-scanning direction X. The main scanning direction Y and the sub-scanning direction X are not limited to specific directions, and may be set as necessary depending on, for example, the mode of the printer 10.

Figure 2:
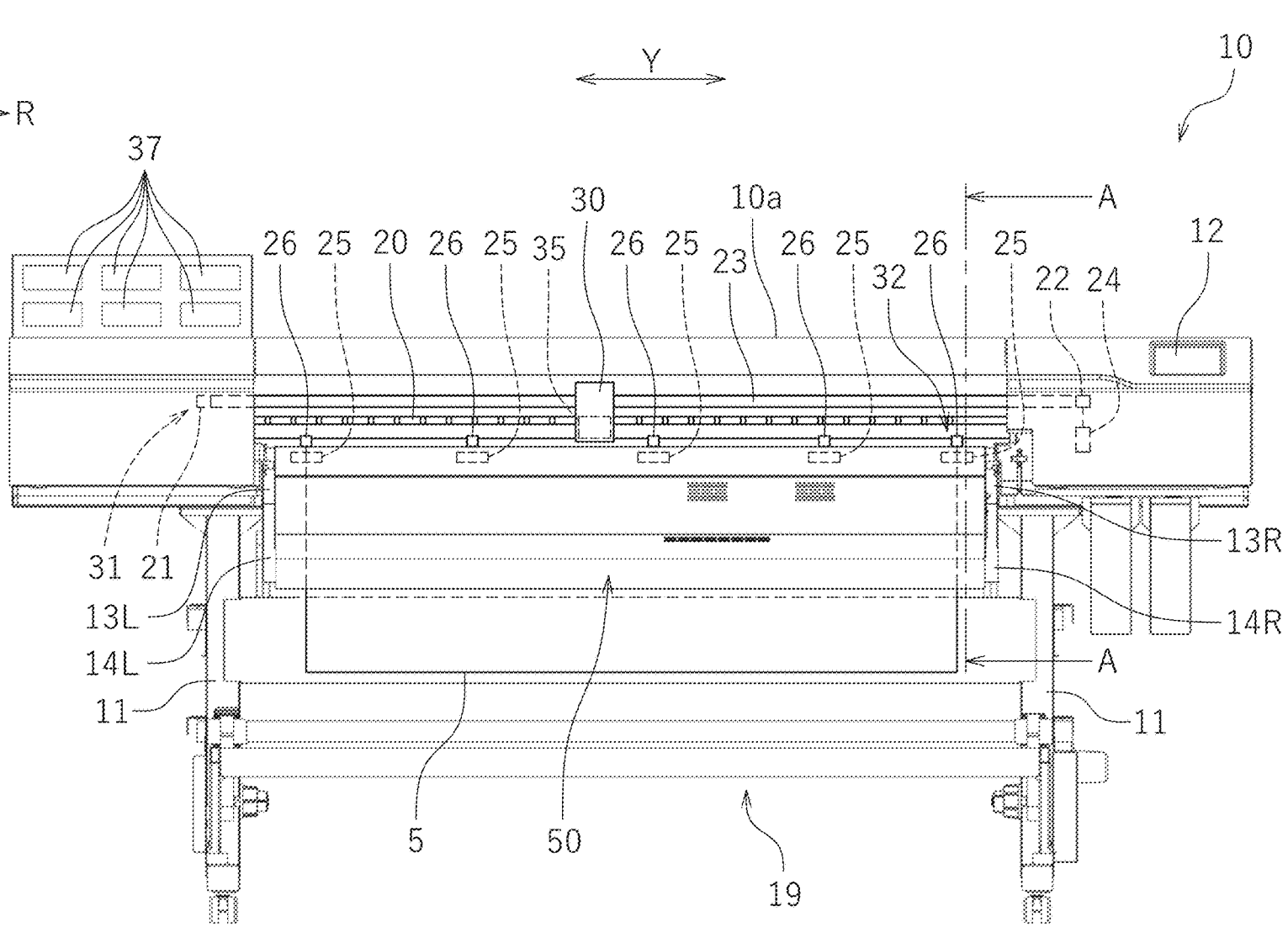
FIG. 2 is a front view of a printer according to a preferred embodiment of the present invention.
Figure 4:
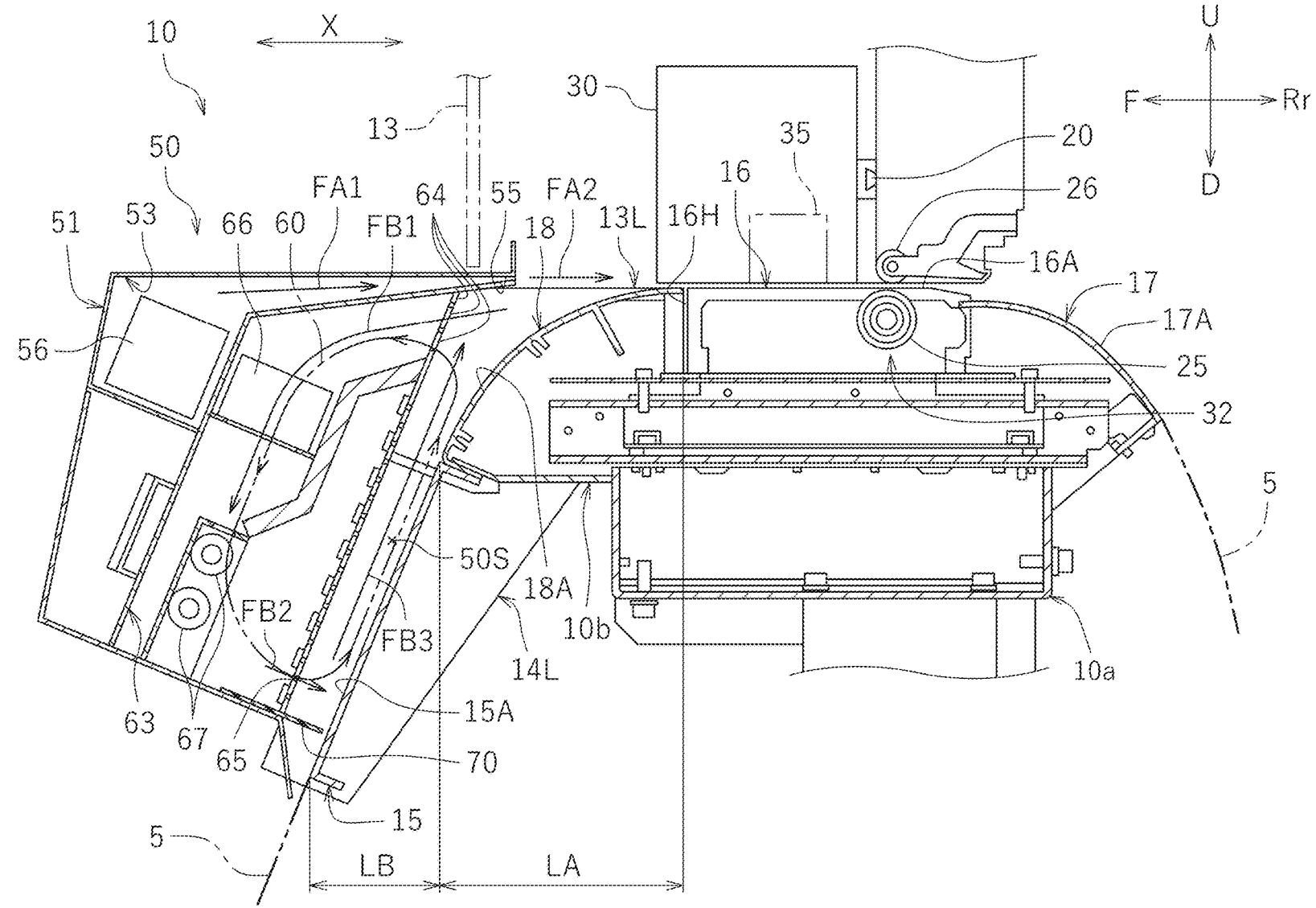
FIG. 4 is a cross-sectional view taken along line A-A in FIG. 2.

As illustrated in FIG. 1, the printer 10 includes a body 10*a*, legs 11, an operation panel 12, and a front cover 13. The body 10*a* includes a casing extending in the main scanning direction Y. The legs 11 support the body 10*a*, and are disposed on the lower surface of the body 10*a*. The operation panel 12 is disposed on the front surface at the right side of the body 10*a*, for example. The location of the operation panel 12 is not specifically limited. The operation panel 12 is a panel with which a user performs operation concerning printing. Although not shown, the operation panel 12 includes, for example, a display section for displaying information on printing, such as a resolution and a thickness of ink, and a status of the printer 10 during printing, and an input section for inputting information concerning printing. The front cover 13 is pivotably disposed on the body 10*a*. As illustrated in FIG. 4, the front cover 13 is disposed forward (i.e., downstream in the sub-scanning direction X) of the carriage 30. The front cover 13 is made of, for example, a transparent acrylic resin. FIG. 2 does not show the front cover 13.

As illustrated in FIG. 4, the printer 10 includes a platen 16. The recording medium 5 is placed on the platen 16. Printing on the recording medium 5 is performed on the platen 16. The platen 16 extends in the main scanning direction Y. The platen 16 is disposed in a center portion of the body 10*a*. The platen 16 has a flat upper surface 16A.

Figure 3:
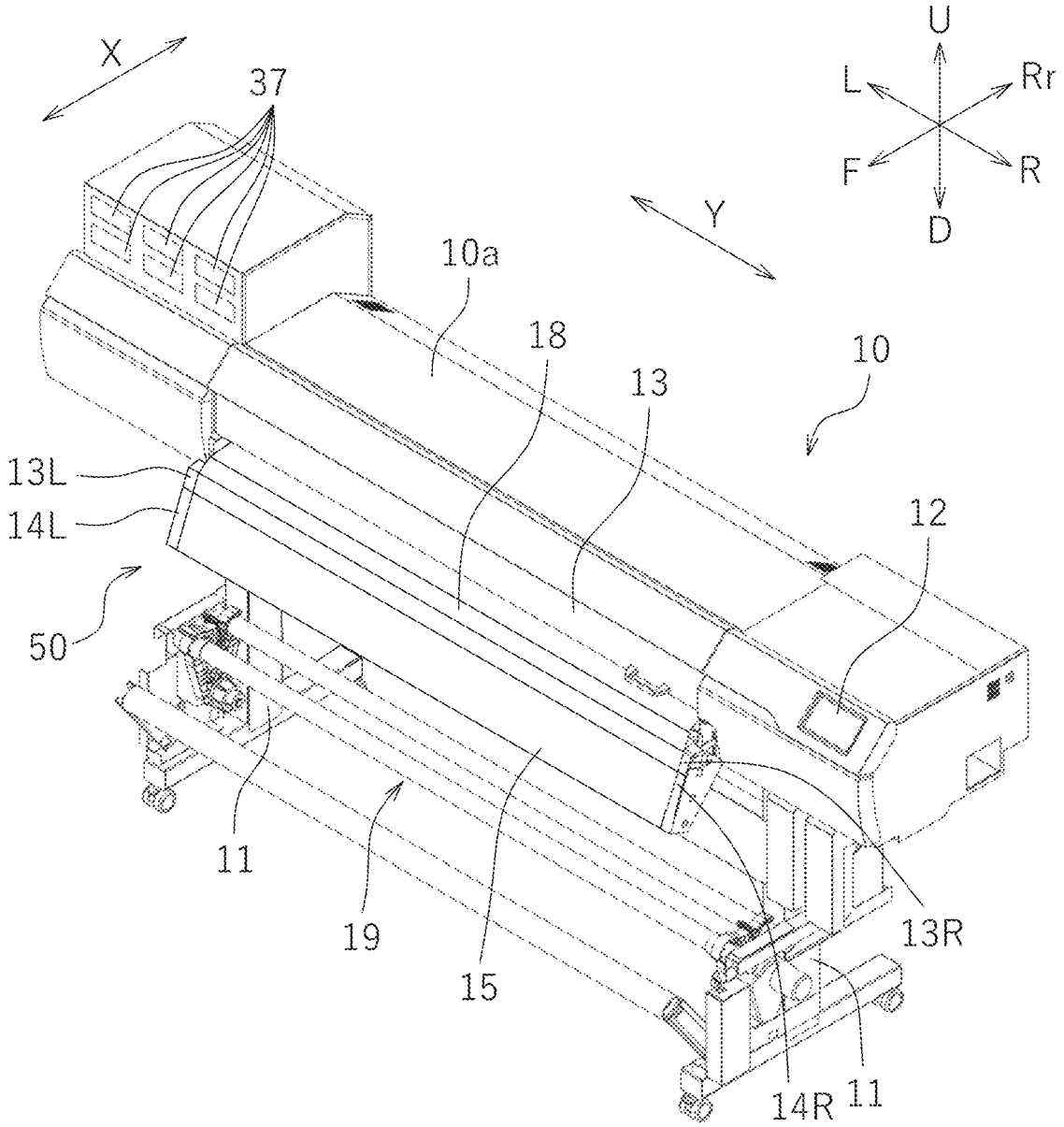
FIG. 3 is a perspective view of a printer from which a drying device according to a preferred embodiment of the present invention is detached.

As illustrated in FIG. 3, the body 10*a* includes a right middle frame 13R, a left middle frame 13L, a right arm 14R, a left arm 14L, and a lower apron 10*b* (see FIG. 4). The right middle frame 13R and the left middle frame 13L are respectively disposed at the right and the left of a first guide member 18 described later, and attached to the body 10*a*. The first guide member 18 is attached to the right middle frame 13R and the left middle frame 13L. The right arm 14R and the left arm 14L are respectively disposed at the right and the left of the second guide member 15, fixed to the right middle frame 13R and the left middle frame 13L. A second guide member 15 is attached to the right arm 14R and the left arm 14L. The lower apron 10*b* is fixed to the body 10*a* and extends forward (toward the downstream side in the sub-scanning direction X) from the body 10*a*. The right middle frame 13R, the left middle frame 13L, the right arm 14R, and the left arm 14L are located forward of the platen 16 (see FIG. 4). The right middle frame 13R and the right arm 14R are located at the right of the platen 16. The left middle frame 13L and the left arm 14L are located at the left of the platen 16. The right arm 14R is located below the right middle frame 13R. The left arm 14L is located below the left middle frame 13L. The right arm 14R and the left arm 14L support a drying device 50 (see FIG. 1) described later.

As illustrated in FIG. 4, the printer 10 includes an upstream guide member 17, the first guide member 18, and the second guide member 15. The upstream guide member 17 is disposed rearward (i.e., upstream in the sub-scanning direction X) of the platen 16. The upstream guide member 17 is supported by the body 10*a*. The upper surface 17A of the upstream guide member 17 tilts obliquely upward from the rear toward the front (i.e., from the upstream side toward the downstream side in the sub-scanning direction X). The upstream guide member 17 has an arc shape in cross section, for example. The upstream guide member 17 is curved to extend downward in a direction away from the platen 16. The upstream guide member 17 guides movement of the recording medium 5. That is, the upstream guide member 17 guides movement of the recording medium 5 to the platen 16.

As illustrated in FIG. 4, the first guide member 18 is disposed forward (i.e., downstream in the sub-scanning direction X) of the platen 16. The first guide member 18 is disposed next to the platen 16 in the sub-scanning direction X. The first guide member 18 is attached to the lower apron 10*b* as well as to the right middle frame 13R (see FIG. 3) and the left middle frame 13L to be thereby supported by the body 10*a*. The first guide member 18 and the platen 16 are not in contact with each other. That is, a gap 16H is located between the first guide member 18 and the platen 16. The upper surface 18A of the first guide member 18 tilts obliquely downward from the rear toward the front (i.e., from the upstream side toward the downstream side in the sub-scanning direction X). The first guide member 18 has an arc shape in cross section, for example. The first guide member 18 is curved to extend downward in a direction away from the platen 16. The first guide member 18 guides movement of the recording medium 5. That is, the first guide member 18 guides movement of the recording medium 5 from the platen 16. The recording medium 5 is conveyed on the upper surface 18A of the first guide member 18. The upper surface 18A of the upper surface 18 has a length LA in the sub-scanning direction X (length in the front-rear direction in FIG. 4) larger than a length LB of the upper surface 15A of the second guide member 15 in the sub-scanning direction X (length in the front-rear direction in FIG. 4).

As illustrated in FIG. 4, the second guide member 15 is disposed forward (i.e., downstream in the sub-scanning direction X) of the first guide member 18 and below the first guide member 18. The second guide member 15 is attached to the right arm 14R (see FIG. 3) and the left arm 14L to be thereby supported by the body 10*a*. The upper surface 15A of the second guide member 15 tilts obliquely downward from the rear toward the front. The second guide member 15 has a substantially U shape in cross section, for example. The second guide member 15 is declined downward in a direction away from the first guide member 18. The second guide member 15 guides movement of the recording medium 5. That is, the second guide member 15 guides movement of the recording medium 5 from the first guide member 18. The recording medium 5 is conveyed on the upper surface 15A of the second guide member 15. Here, the first guide member 18 and the second guide member 15 guides the recording medium 5 to a winding device 19 (see FIG. 1) to wind the recording medium 5 on the platen 16.

The first guide member 18 has a thermal conductivity higher than that of the second guide member 15. This configuration has an intention that the first guide member 18 is made of a material having a high thermal conductivity, such as iron, in order to make uniform or substantially uniform the temperature distribution at the upstream side, whereas the second guide member 15 is made of a material having a low thermal conductivity, such as stainless steel, in order to maintain the temperature (prevent or reduce a decrease in temperature) at the downstream side. Since heat is transferred to a wide range of the first guide member 18, the temperature distribution in the upper surface 18A of the first guide member 18 can be made uniform. In addition, since the second guide member 15 is located below the first guide member 18, heat transfer from the first guide member 18 to the second guide member 15 is suppressed. Accordingly, the temperature of the first guide member 18 can be kept relatively high. Since the second guide member 15 has a thermal conductivity lower than that of the first guide member 18, transfer, to the second guide member 15, of air heated by a drying device 50 (see FIG. 4) described later and discharged toward the second guide member 15 is reduced or prevented. Thus, heat dissipation to the second guide member 15 is reduced or prevented, and air at a relatively high temperature necessary for drying ink in the second guide member 15 is allowed to flow. Accordingly, drying of the recording medium 5 can be promoted on the upper surface 15A of the second guide member 15. Furthermore, since the second guide member 15 defines a circulation path 60 (see FIG. 4, described later), heat dissipation to the second guide member 15 is reduced or prevented so that air in the circulation path 60 circulates with the temperature kept relatively high.

The materials of the first guide member 18 and the second guide member 15 are not specifically limited as long as the relationship in thermal conductivity described above is satisfied. The first guide member 18 is made of, for example, iron (e.g., SECC). The first guide member 18 may be made of aluminum. The second guide member 15 is made of, for example, stainless steel (SUS).

As illustrated in FIG. 2, the printer 10 includes ink heads 35 to discharge ink. The ink heads 35 discharge aqueous ink to the recording medium 5 conveyed in the sub-scanning direction X. The ink heads 35 are disposed above the platen 16. The ink heads 35 are movable in the main scanning direction Y. In this preferred embodiment, the ink heads 35 are connected to ink cartridges 37 through unillustrated ink supply paths. The ink cartridges 37 are detachably disposed at the left end of the body 10*a*, for example.

As aqueous ink, latex ink is preferably used. The latex ink includes a solvent, a coloring material, and a binder resin. In the latex ink, the binder resin is dispersed or emulsified in the solvent. As the solvent, one or more types of water and water-soluble organic solvents (e.g., lower alcohol or lower ketone) that can be uniformly mixed with water may be selectively used. The latex ink includes 50% by mass or more and 90% by mass or less of the solvent with respect to the total mass of latex ink. As the coloring material, a conventional coloring material included in the latex ink may be selectively used. Examples of the coloring material include dyes and pigments such as water-soluble dyes. As the binder resin, a conventional binder resin included in the latex ink may be selected as appropriate. Ink discharged from the ink heads 35 is not limited to aqueous ink, and may be, for example, photocurable ink (e.g., UV curable pigment ink that is cured by UV irradiation, so-called UV ink) or solvent-based pigment ink.

As illustrated in FIG. 2, the printer 10 includes a head moving mechanism 31 and a medium conveying mechanism 32. The head moving mechanism 31 causes the ink heads 35 to move in the main scanning direction Y relative to the recording medium 5 on the platen 16. In this preferred embodiment, the head moving mechanism 31 causes the ink heads 35 to move in the main scanning direction Y. The head moving mechanism 31 herein includes a guide rail 20, a first pulley 21, a second pulley 22, an endless belt 23, a first driving motor 24, and the carriage 30. The guide rail 20 guides movement of the carriage 30 in the main scanning direction Y. As illustrated in FIG. 4, the guide rail 20 is disposed above the platen 16. As illustrated in FIG. 2, the guide rail 20 extends in the main scanning direction Y. The first pulley 21 is disposed at the left end of the guide rail 20. The second pulley 22 is disposed at the right end of the guide rail 20. The belt 23 is wound around the first pulley 21 and the second pulley 22. In this preferred embodiment, the first driving motor 24 is connected to the second pulley 22. The first driving motor 24 may be connected to the first pulley 21. When the first driving motor 24 is driven to cause the second pulley 22 to rotate, the belt 23 runs between the first pulley 21 and the second pulley 22.

As illustrated in FIG. 2, the carriage 30 is attached to the belt 23. The carriage 30 is disposed above the platen 16. As illustrated in FIG. 4, the carriage 30 is slidably engaged with the guide rail 20. The ink heads 35 are mounted on the carriage 30. In this preferred embodiment, when the belt 23 runs by driving of the first driving motor 24 so that the carriage 30 moves in the main scanning direction Y, the head moving mechanism 31 causes the ink heads 35 mounted on the carriage 30 to move in the main scanning direction Y.

The medium conveying mechanism 32 moves the recording medium 5 on the platen 16 in the sub-scanning direction X relative to the ink heads 35. The medium conveying mechanism 32 herein causes the recording medium 5 on the platen 16 to move in the sub-scanning direction X. The medium conveying mechanism 32 is not limited to a specific configuration. As illustrated in FIG. 4, in this preferred embodiment, the medium conveying mechanism 32 includes a grit roller 25, a pinching roller 26, and a second driving motor (not shown) for driving the grit roller 25. The grit roller 25 is disposed on the platen 16. The grit roller 25 herein is at least partially embedded in the platen 16. The pinching roller 26 presses the recording medium 5 from above. The pinching roller 26 is disposed above the grit roller 25. The pinching roller 26 is disposed at a position facing the grit roller 25. The pinching roller 26 is movable upward and downward. When the second driving motor is driven to cause the grit roller 25 to rotate with the recording medium 5 sandwiched between the grit roller 25 and the pinching roller 26, the recording medium 5 is conveyed in the sub-scanning direction X. The location and the number of the grit rollers 25 and the location and the number of the pinching rollers 26 are not specifically limited.

As illustrated in FIG. 1, the printer 10 includes the drying device 50. The drying device 50 dries ink discharged onto the recording medium 5. The drying device 50 sends air toward the recording medium 5 on the platen 16. The drying device 50 sends air toward the recording medium 5 guided by the first guide member 18 and the second guide member 15. As illustrated in FIG. 4, the drying device 50 is disposed forward (i.e., downstream in the sub-scanning direction X) of the platen 16. The drying device 50 faces at least the second guide member 15. In this preferred embodiment, the drying device 50 faces the first guide member 18 and the second guide member 15. The drying device 50 partially overlaps with the first guide member 18 in plan view. The drying device 50 overlaps with the second guide member 15 in plan view. As illustrated in FIG. 2, the drying device 50 partially overlaps with the first guide member 18 and the second guide member 15 in front view. The drying device 50 is detachably attached to the right arm 14R and the left arm 14L of the body 10*a*.

As illustrated in FIG. 4, the drying device 50 includes a body case 51 (see also FIG. 1) extending in the main scanning direction Y, a first fan 56 for initial drying and a second fan 66 for complete drying disposed in the body case 51, and heaters 67. The body case 51 includes a first inlet port 54 (see FIG. 1) at the right end of the body case 51, a first outlet port 55 at the rear end of the body case 51, a second inlet port 64 in a rear portion of the body case 51, and second outlet ports 65 in a rear portion of the body case 51.

Figure 5:
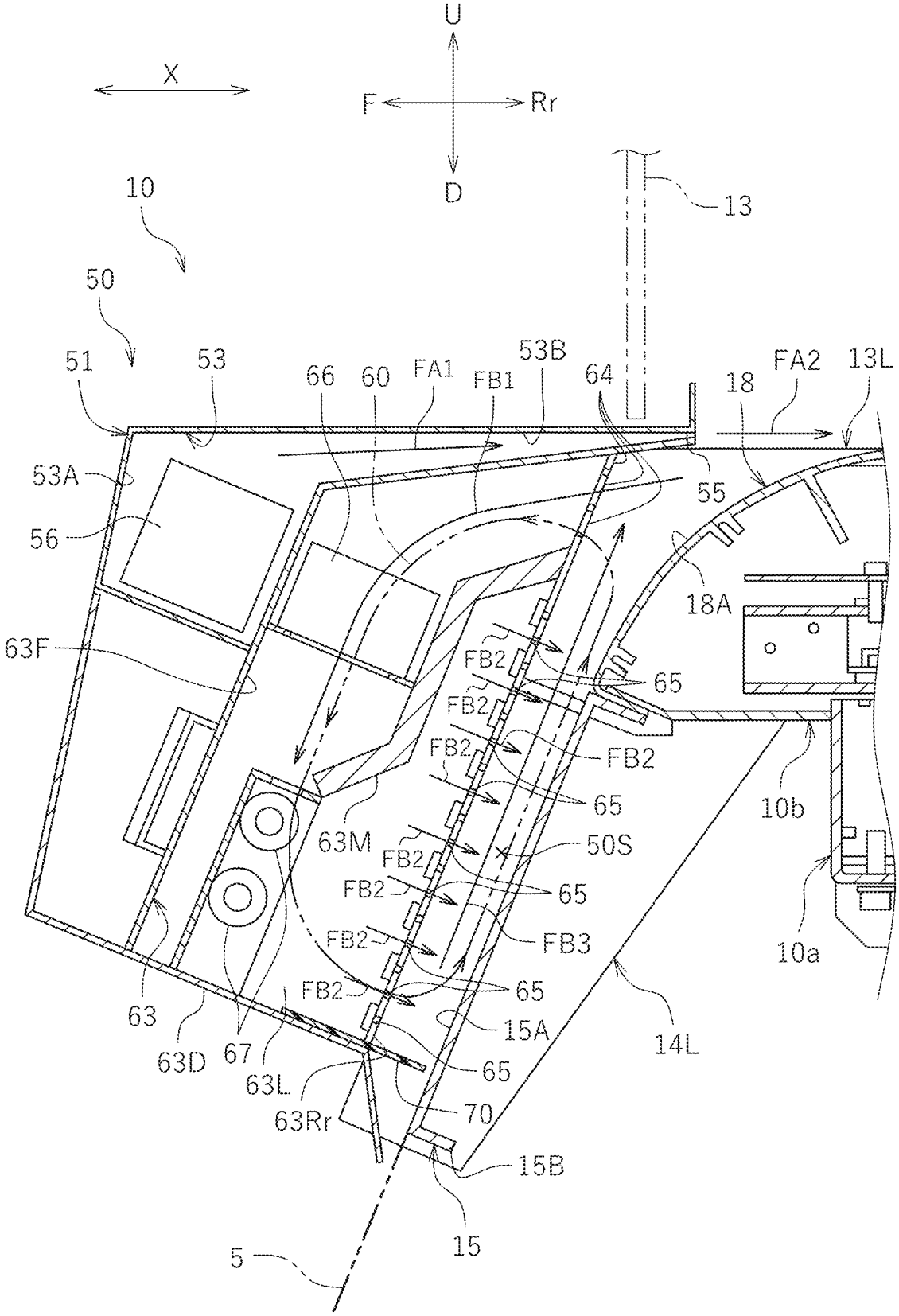
FIG. 5 is a cross-sectional view of a drying device according to a preferred embodiment of the present invention.

As illustrated in FIG. 5, the body case 51 includes a first chamber 53 and a second chamber 63. The first chamber 53 and the second chamber 63 are separated from each other by a partition wall 63F. The first chamber 53 includes an intake chamber 53A located forward (i.e., downstream in the sub-scanning direction X) of the second chamber 63, and an exhaust chamber 53B communicating with the intake chamber 53A and located above the second chamber 63. In the exhaust chamber 53B, an opening area of the first outlet port 55 is smaller than the area of an opening at the intake chamber 53A. That is, the exhaust chamber 53B is tapered toward the first outlet port 55. The second chamber 63 is disposed rearward of the first chamber 53. The first chamber 53 includes the first inlet port 54 and the first outlet port 55. The second chamber 63 includes the second inlet port 64 and the second outlet ports 65.

As illustrated in FIG. 1, the first inlet port 54 is provided at the front end (i.e., downstream end in the sub-scanning direction X) of the body case 51. The first inlet port 54 is provided at the right end of the body case 51. The first inlet port 54 is open rightward. The first inlet port 54 does not face the first guide member 18 or the second guide member 15. The first inlet port 54 has a slit shape. The first inlet port 54 is included in the intake chamber 53A. The first inlet port 54 causes the outside of the body case 51 to communicate with the first chamber 53. The first inlet port 54 allows outside air to be taken in the body case 51 (in the first chamber 53 in this preferred embodiment). The first inlet port 54 may be provided at the left end of the body case 51.

As illustrated in FIG. 5, the first outlet port 55 extends in the main scanning direction Y and is open toward the platen 16. In this preferred embodiment, the first outlet port 55 is open rearward (i.e., to the upstream side in the sub-scanning direction X). The first outlet port 55 has a slit shape. The first outlet port 55 is located above the upper surface 16A of the platen 16. The first outlet port 55 is located above the first inlet port 54. The first outlet port 55 is disposed rearward of the second outlet ports 65. The first inlet port 54 is included in the exhaust chamber 53B. The first outlet port 55 communicates with the first inlet port 54. The first outlet port 55 causes the first chamber 53 to communicate with the outside of the body case 51.

As illustrated in FIG. 5, the first fan 56 is disposed in the first chamber 53. More specifically, the first fan 56 is disposed in the intake chamber 53A. The drying device 50 includes one first fan 56. The number of first fans 56 is not limited to one. The first fan 56 is located at a side of the first inlet port 54. In this preferred embodiment, the first fan 56 is disposed at the left of the first inlet port 54. The first fan 56 sucks air from the first inlet port 54 and lets the air to be discharged toward the platen 16 (rearward in this preferred embodiment) from the first outlet port 55 (see FIG. 4).

As illustrated in FIG. 5, the second inlet port 64 is provided in a rear wall 63Rr of the body case 51. The second inlet port 64 is open toward the first guide member 18. The second inlet port 64 has a rectangular shape. The second inlet port 64 causes the outside of the body case 51 and the second chamber 63 to communicate with each other. The second inlet port 64 allows outside air to be taken in the body case 51 (in the second chamber 63 in this preferred embodiment). The second inlet port 64 is disposed below the first outlet port 55. The second inlet port 64 is disposed forward (i.e., downstream in the sub-scanning direction X) of the first outlet port 55. The second inlet port 64 is an example of an inlet port.

As illustrated in FIG. 5, the second outlet ports 65 are provided in the rear wall 63Rr of the body case 51. The second outlet ports 65 are open toward the first guide member 18 and the second guide member 15. Each of the second outlet ports 65 has a circular shape, for example. The second outlet ports 65 communicate with the second inlet port 64. The second outlet ports 65 cause the second chamber 63 to communicate with the outside of the body case 51. The second outlet ports 65 are disposed below the first outlet port 55. The second outlet ports 65 are disposed below the second inlet port 64. The second outlet ports 65 are disposed forward (i.e., downstream in the sub-scanning direction X) of the second inlet port 64. The second outlet ports 65 are an example of outlet ports.

As illustrated in FIG. 5, the second fan 66 is disposed in the second chamber 63. The second fan 66 is located between the second inlet port 64 and the heaters 67. The second fan 66 sucks air from the second inlet port 64 and discharges air from the second outlet ports 65 toward the first guide member 18 and the second guide member 15 (rearward and obliquely downward in this preferred embodiment) through the heaters 67. The airflow rate of the second fan 66 is smaller than that of the first fan 56. The second fan 66 is an example of a fan.

As illustrated in FIG. 5, the heaters 67 are disposed in the body case 51. The heaters 67 are disposed in the second chamber 63. In this preferred embodiment, two heaters 67 are disposed in the second chamber 63 and arranged in the top-bottom direction. The heaters 67 extend in the main scanning direction Y. The heaters 67 heat air sent by the second fan 66. The heaters 67 are, for example, sheathed heaters. The inside of the second chamber 63 is divided by an inner partition wall 63M into a space having the second inlet port 64 and provided with the second fan 66, and a space provided with the heaters 67 and facing the second outlet ports 65. The walls defining the second chamber 63, specifically, the partition wall 63F separating the first chamber 53 and the second chamber 63 from each other, the rear wall 63Rr having the second inlet port 64 and the second outlet ports 65, a lower wall 63D of the body case 51, a right wall 63R (see FIG. 1) of the body case 51, and a left wall 63L of the body case 51 are made of, for example, stainless steel in order to reduce or prevent dissipation of air heated by the heaters 67 from the second chamber 63. The inner partition wall 63M is also made of, for example, stainless steel in order to reduce or prevent dissipation of air heated by the heaters 67 from the second chamber 63.

As illustrated in FIG. 5, the body case 51 includes a projecting plate 70 extending from the lower end of the body case 51 toward the second guide member 15 (rearward and obliquely downward in this preferred embodiment). The projecting plate 70 is located below the second outlet ports 65. The projecting plate 70 is located above a lower end 15B of the second guide member 15. The projecting plate 70 extends in the main scanning direction Y.

The projecting plate 70 is made of an elastically deformable material. The projecting plate 70 is made of rubber, for example.

An airflow of the drying device 50 will now be described. First, the first fan 56 causes air sucked from the first inlet port 54 to flow in the main scanning direction Y in the intake chamber 53A of the first chamber 53. As indicated by arrow FA1 in FIG. 5, air flowing in the intake chamber 53A enters the exhaust chamber 53B to be narrowed and sent toward the first outlet port 55 at an increasing flow velocity. Air is rectified in the exhaust chamber 53B, and is discharged from the first outlet port 55 toward the platen 16, as indicated by arrow FA2 in FIG. 5. The first outlet port 55 herein has a slit shape extending in the main scanning direction Y, and air sent toward the first outlet port 55 at an increasing flow velocity is released from the slit opening. Thus, air is allowed to be sent in the entire region of the platen 16 in the main scanning direction Y.

As indicated by arrow FB1 in FIG. 5, the second fan 66 causes air sucked from the second inlet port 64 to flow toward the heaters 67. As indicated by arrow FB2 in FIG. 5, air heated by the heaters 67 flows from the plurality of second outlet ports 65 toward the first guide member 18 and the second guide member 15. Air that has reached the recording medium 5 guided by the first guide member 18 and the second guide member 15 flows upward with an upward airflow as indicated by arrow FB3 in FIG. 5 and flows into the second inlet port 64. As described above, air heated by the heaters 67 circulates in the second chamber 63 and a space 50S. The space 50S is surrounded by the upper surface 18A of the first guide member 18, the upper surface 15A of the second guide member 15, and the body case 51. That is, in the printer 10, the circulation path 60 in which air at a temperature higher than air discharged from the first outlet port 55 circulates is formed in the space 50S and the second chamber 63. In this preferred embodiment, the first guide member 18 is made of a material having a high thermal conductivity, such as iron, in order to make uniform or substantially uniform the temperature distribution at the upstream side, and the second guide member 15 is made of a material having a low thermal conductivity, such as stainless steel, in order to maintain the temperature (reduce or prevent a decrease in temperature) at the downstream side. Air discharged from the plurality of second outlet ports 65 needs to be sent to the recording medium 5 onto which ink is discharged (the recording medium 5 after printing) in a state where heat necessary for drying the ink is not released. In view of this, the material of a conveyance path of the recording medium 5 after printing is preferably made of a material having a low thermal conductivity. On the other hand, in the conveyance path of the recording medium 5 immediately after printing, surface temperature distribution needs to be uniform from the viewpoint of printing quality after drying and quality in winding the recording medium 5. A material having a low thermal conductivity causes a temperature increase only in a portion subjected to heat from, for example, the heaters, and the surface temperature distribution cannot be made uniform or substantially uniform. In view of this, the conveyance path includes the first guide member 18 and the second guide member 15, and the first guide member 18 is made of a material having a high thermal conductivity such as iron, whereas the second guide member 15 is made of a material having a low thermal conductivity such as stainless steel in order to reduce or prevent dissipation of heated air and make uniform or substantially uniform the surface temperature. Since the drying device 50 includes the projecting plate 70 located below the second outlet ports 65, it is possible to reduce or prevent an outflow of air discharged from the second outlet ports 65 to the outside from space between a rear portion of the body case 51 and the second guide member 15. The number of the second outlet ports 65 open toward the second guide member 15 is larger than the number of the second outlet ports 65 open toward the first guide member 18. This is because an emphasis is placed on drying of ink by making uniform or substantially uniform the surface temperature on the first guide member 18, whereas ink is dried by heated air in the second guide member 15.

As described above, in the printer 10 according to this preferred embodiment, air heated by the heaters 67 of the drying device 50 is sent to the recording medium 5 through the second outlet ports 65. In this preferred embodiment, since the second outlet ports 65 are open toward the second guide member 15, drying of ink on the recording medium 5 on the upper surface 15A of the second guide member 15 is promoted by the high temperature air immediately after being heated by the heater 67. Since the thermal conductivity of the second guide member 15 is lower than the thermal conductivity of the first guide member 18, heat dissipation to the second guide member 15 is reduced or prevented, and air at a relatively high temperature is allowed to flow in the second guide member 15. That is, in the second guide member 15, drying of ink discharged onto the recording medium 5 is promoted. In addition, heated air flowing from the second outlet ports 65 toward the second guide member 15 rises and flows on the upper surface 18A of the first guide member 18. Accordingly, drying of ink on the recording medium 5 on the upper surface 18A of the first guide member 18 is promoted, and the first guide member 18 is heated. Since the thermal conductivity of the first guide member 18 is higher than the thermal conductivity of the second guide member 15, heat is transferred to a wide range in the first guide member 18 so that temperature distribution in the first guide member 18 is made uniform or substantially uniform. That is, it is possible to reduce or prevent the occurrence of variation in drying ink in the first guide member 18, while promoting drying of ink in the first guide member 18. In this preferred embodiment, since the second guide member 15 having a low thermal conductivity is located below the first guide member 18, transfer of heat of the first guide member 18 to the second guide member 15 through the contact portion is reduced or prevented so that the temperature of the first guide member 18 is maintained.

In the printer 10 according to this preferred embodiment, the length LA of the upper surface 18A of the first guide member 18 in the sub-scanning direction X is larger than the length LB of the upper surface 15A of the second guide member 15 in the sub-scanning direction X. The thermal conductivity of the first guide member 18 is higher than the thermal conductivity of the second guide member 15, and heat is transferred to a wide range in the first guide member 18. Thus, a longer time is obtained for conveyance of the recording medium 5 by the first guide member 18 to which heat is easily transferred so that ink discharged onto the recording medium 5 can be effectively dried at the early stage.

In the printer 10 according to this preferred embodiment, the body case 51 includes the projecting plate 70 located below the second outlet ports 65, extending in the main scanning direction Y, and extending from the lower end of the body case 51 toward the second guide member 15. Accordingly, an outflow of air heated by the heaters 67 toward the outside from below the body case 51 can be reduced or prevented, and an inflow of cold outside air onto the second guide member 15 from below the body case 51 can be reduced or prevented.

In the printer 10 according to this preferred embodiment, the projecting plate 70 is located above the lower end 15B of the second guide member 15. Accordingly, it is possible to further ensure reduction or prevention of an inflow of cold outside air onto the second guide member 15 from below the body case 51.

In the printer 10 according to this preferred embodiment, the body case 51 includes the second inlet port 64 that is open toward the first guide member 18. The second inlet port 64 is located above the second outlet ports 65, causes air heated by the heaters 67 to flow onto the upper surface 15A of the second guide member 15 from the inside (the second chamber 63 in this preferred embodiment) of the drying device 50 through the second outlet ports 65 and to circulate to the inside of the drying device 50 from the second inlet port 64 by way of the upper surface 18A of the first guide member 18. Thus, the second guide member 15 and the first guide member 18 are heated (warmed) with power consumption of the heaters 67 reduced.

The foregoing description is directed to the preferred embodiments of the present invention. The preferred embodiments described above, however, are merely examples, and the present invention can be performed in various modes.

In the preferred embodiments described above, the second outlet ports 65 are open toward the first guide member 18 and the second guide member 15. However, the present invention is not limited to this example. The second outlet ports 65 only need to be open toward at least the second guide member 15.

In the preferred embodiments described above, the second fan 66 is located between the second inlet port 64 and the heaters 67. However, the present invention is not limited to this example. The second fan 66 may be located between the heaters 67 and the second outlet ports 65.

In the preferred embodiments described above, the first guide member 18 and the second guide member 15 are continuous and tilt downward such that the first guide member 18 and the second guide member 15 tilt at the same angle. However, the present invention is not limited to this example. For example, the tilt angles of the first guide member 18 and the second guide member 15 may be different from each other, and/or a step may be provided between the first guide member 18 and the second guide member 15 such that the second guide member 15 is lower than the first guide member 18. In the sub-scanning direction X (i.e., the front-rear direction), the first guide member 18 and the second guide member 15 may overlap with each other. Arrangement of the first guide member 18 and the second guide member 15 may be changed depending on, for example, deformation of the recording medium 5 so that the front end of the recording medium 5 does not enter a gap between the first guide member 18 and the second guide member 15.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink jet printer comprising:

a platen on which a recording medium is placed;

a carriage disposed above the platen and movable in a main scanning direction;

an ink head mounted on the carriage to discharge ink onto the recording medium, the recording medium being conveyed in a sub-scanning direction orthogonal to the main scanning direction;

a first guide including an upper surface on which the recording medium is conveyed, the first guide being disposed downstream of the platen in the sub-scanning direction to guide movement of the recording medium;

a second guide including an upper surface on which the recording medium is conveyed, the upper surface being tilted obliquely downward from an upstream side to a downstream side in the sub-scanning direction, the second guide being disposed below the first guide and downstream of the first guide in the sub-scanning direction to guide movement of the recording medium; and a dryer facing at least the second guide to send air toward the recording medium; wherein the dryer includes:

a body case including an output port that is open toward at least the second guide;

a fan disposed in the body case to send air toward the recording medium through the outlet port; and a heater disposed in the body case to heat air sent by the fan; and the first guide has a thermal conductivity higher than a thermal conductivity of the second guide.

2. The ink jet printer according to claim 1, wherein a length in the sub-scanning direction of the upper surface of the first guide is larger than a length in the sub-scanning direction of the upper surface of the second guide.

3. The ink jet printer according to claim 1, wherein the body case includes a projecting plate that is located below the outlet port, extends in the main scanning direction, and extends from a lower end of the body case toward the second guide.

4. The ink jet printer according to claim 3, wherein the projecting plate is located above a lower end of the second guide.

5. The ink jet printer according to claim 1, wherein the body case includes an inlet port that is open toward the first guide.

* * * * *